US007988198B2

(12) United States Patent
Wang

(10) Patent No.: US 7,988,198 B2
(45) Date of Patent: Aug. 2, 2011

(54) PHOTO ALBUM

(76) Inventor: Eugene Wang, Temple City, CA (US)

( * ) Notice: Subject to any disclaimer, the term of this patent is extended or adjusted under 35 U.S.C. 154(b) by 706 days.

(21) Appl. No.: 12/074,036

(22) Filed: Feb. 29, 2008

(65) Prior Publication Data

US 2009/0218804 A1 Sep. 3, 2009

(51) Int. Cl.
*B42D 3/00* (2006.01)

(52) U.S. Cl. ..... 281/29; 281/22; 412/4

(58) Field of Classification Search ..... 281/22, 281/29, 34, 38, 31; 412/19–20, 4, 8
See application file for complete search history.

(56) References Cited

U.S. PATENT DOCUMENTS 5,403,138 A * 4/1995 Otake et al. ..... 412/1
2005/0269815 A1* 12/2005 Silverman ..... 281/29
* cited by examiner

*Primary Examiner* — Dana Ross
*Assistant Examiner* — Matthew G Katcoff
(74) *Attorney, Agent, or Firm* — Raymond Y. Chan; David and Raymond Patent Firm

(57) ABSTRACT

An album includes a front cover panel, a back cover panel, and a spine panel extending between the front and the back cover panels edge-to-edge. A folding arrangement, which couples between a last album page and the back cover panel, includes a flexible sheet having two longitudinal edges coupling at an outer side of last album page and an inner side of the back cover panel to retain the last album page being overlapped on the back cover panel in a slidably movable manner. When the album is folded at an opened position, the front cover panel, the spine panel, and the back cover panel are aligned to form a planer backing for providing a completely plane on the surface of the album.

22 Claims, 10 Drawing Sheets

PHOTO ALBUM

FIELD OF THE INVENTION

The present invention relates to a photo album, and more particularly to a folding arrangement coupling for a photo album, wherein the folding arrangement comprises a flexible sheet adapted to allow the front cover panel, the spine panel, and the back cover panel to from a planer backing for aligning on a surface so as to prevent the photo album from being damaged.

BACKGROUND OF THE PRESENT INVENTION

Description of Related Arts

Nowadays, an album for a collection such as photo, CD, printing, and file is commonly used in our daily life. An album can be a record of the development of a baby, a wedding, traveling, and so on. Accordingly, a photo album comprises a relatively heavy and thick cover and a plurality of pages for holding the photos thereon. Through photo album, people can keep the best moment in their life. For example, she or he thoughts flashed back to their wedding day. However, the conventional photo album has several drawbacks.

In order to preserve the photos well, the photo album usually has heavy weighted papers as the photo pages. They provide a secure way to preserve the collection of photo, postcards or stamps. Even through constantly page turning, the photos in the album still remains in good condition. However, when the reader wants to turn to the next page, the present page cannot be fully turned to overlap on the previous page. The resultant force between the front cover, the back cover, and the album page is not even, the photo album will be opened in an unstable/unbalance manner such that the previous page cannot be fully covered on the previous page but still suspend in the air. It is really inconvenient for people to read the book because they always need to press on the previous page to ensure a completely plane on the surface of the photo album while reading.

Even the photo album is made of very heavy material, the frequency browsing the photo album in an unbalance manner makes the photo album is torn easily especially for the spin panel. In other words, the spin panel is folded when the front and back panels are folded on a table surface. Therefore, the edges of the spin panel will be kept sliding on the table surface when the album pages are turned. Once the spin panel is torn, the entire album cover is broken into pieces.

Furthermore, the common drawback of the above mentioned photo albums is that the photo folder is designed not to securely hold the photos in the photo album. Once the user wants to read the photo album, the unbalance manner of the photo album makes the photos change its original position. What make matter worse, the album may drop the photos out. It is obvious that how severely damage will impact on the photos. To sum up, it obviously can not achieve the current needs based on the existing photo album.

SUMMARY OF THE PRESENT INVENTION

A main object of the present invention is to provide a photo album, wherein the folding arrangement comprises a flexible sheet adapted to allow the front cover panel, the spine panel, and the back cover panel to from a planer backing for providing a completely plane for aligning on a surface so as to prevent the photo album from being damaged.

Another object of the present invention is to provide a photo album, wherein the overall weight of the photo album is evenly supported by the front cover panel, the back cover panel, and each album page such that when the album cover is folded at an opened position, the center of gravity of the photo album will remain the same in a balance manner.

Another object of the present invention is to provide a photo album, wherein when the photo album is opened, the album pages are shifted to slide on the album cover to keep the two neighboring album pages are aligned in a planer manner, such that the photos on the corresponding album pages will be kept in a stable manner.

Another object of the present invention is to provide a photo album, wherein the structural configuration of the folding arrangement coupling is simple and the manufacturing cost is low but highly enhance the endurance of the photo album.

Accordingly, in order to accomplish the above objects, the present invention provides a photo album comprising a book-like album cover and an album retainer. The album cover comprises a front cover panel, a back cover panel, and a spine panel extending between the front and back cover panels edge-to-edge. The album retainer comprises a plurality of album pages to define a first album page overlappedly coupled with the front cover panel, a last album page, a plurality of intermediate album pages overlapping between the first and last album pages, wherein inner edges of the album pages are bound with each other such that the album retainer is adapted to be turned from the first album page to the last album page.

The photo album further comprises a folding arrangement coupling between the last album page and the back cover panel at a position that the last album page is overlapped with the back cover panel in a slidably movable manner, wherein when the album cover is folded at an opened position, the last album page is overlappedly slid along the back cover panel to allow the front cover panel, the spine panel, and the back cover panel to form a flat planer backing, while two neighboring album pages are aligned in a planer manner.

The folding arrangement further comprises a flexible sheet having two longitudinal edges coupling at an outer side of last album page and an inner side of the back cover panel to retain the last album page being overlapped on the back cover panel in a slidably movable manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
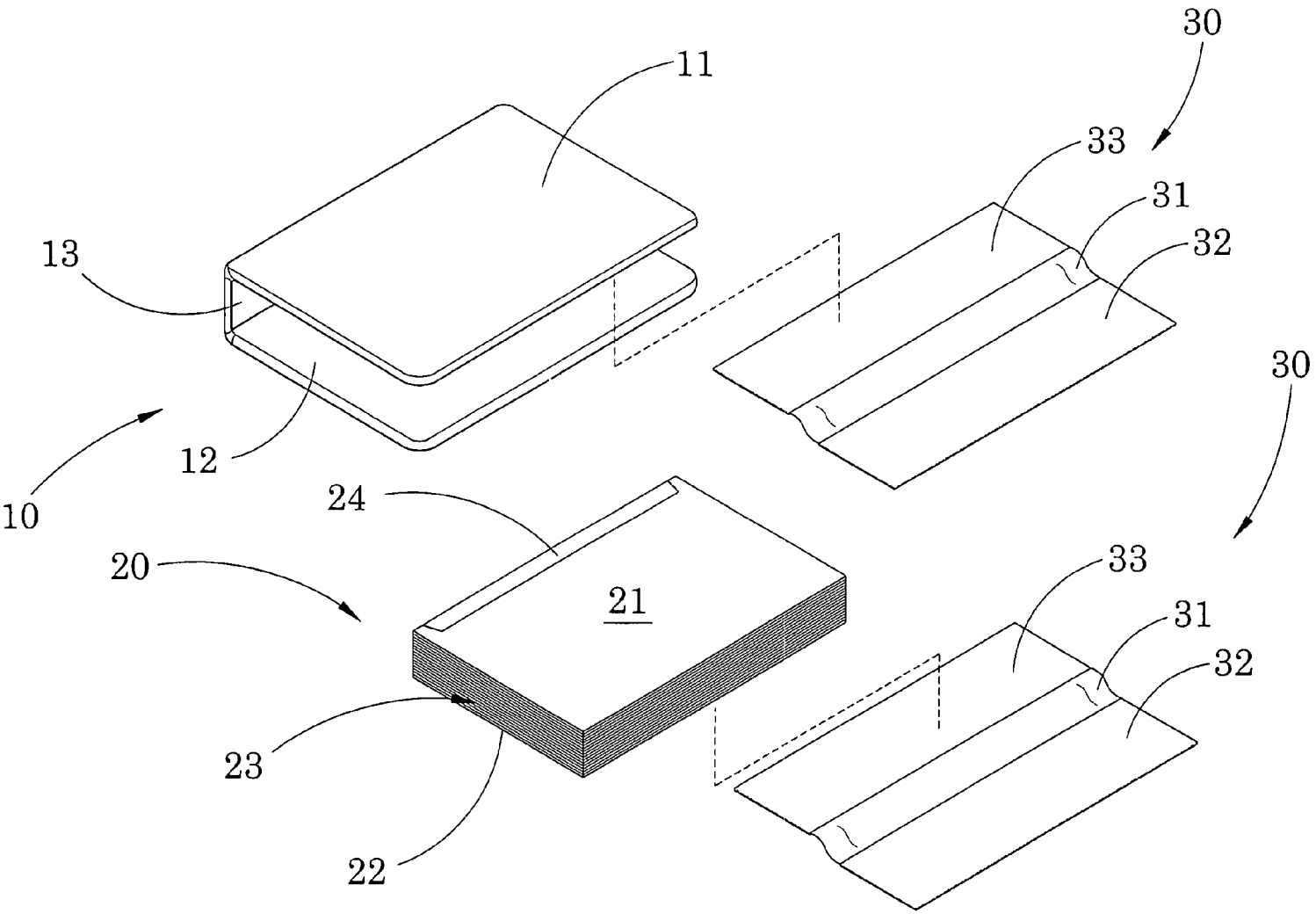
FIG. 1 is an exploded perspective view of a photo album according to a preferred embodiment of the present invention.

Referring to FIGS. 1 to 5 of the drawings, an album according to a preferred embodiment of the present invention is illustrated, wherein the album, which is embodied as a photo album, comprises a book-like album cover 10, an album retainer 20, and a folding arrangement 30.

The book-like album cover 10 comprises a front cover panel 11, a back cover panel 12, and a spine panel 13 extending between the front and back cover panels 11, 12 edge-to-edge.

The album retainer 20 comprises a plurality of album pages to define a first album page 21 overlappedly coupled with the front cover panel 11, the last album page 22, a plurality of intermediate album pages 23 overlapping between the first and last album pages 21, 22, wherein inner edges of the album pages are bound with each other such that the album retainer 20 is adapted to be turned from the first album page 21 to the last album page 22.

The album retainer 20 further comprises a plurality of edge leaves 24 connecting the inner edges of the album pages respectively, wherein each of the edge leaves 24 coupling between two sequent album pages at a position the inner edges of the sequent album pages are spaced part from each other such that two neighboring album pages are aligned in a planer manner when the neighboring album pages are folded to overlap on the front and back cover panels 11, 12 respectively at the opened position.

The folding arrangement 30 is coupling between the last album page 22 and the back cover panel 12 at a position that the last album page 22 is overlapped with the back cover panel 12 in a slidably movable manner, wherein when the album cover 10 is folded at an opened position, the last album page 22 is overlappedly slid along the back cover panel 12 to allow the front cover panel 11, the spine panel 13, and the back cover panel 12 to form a flat planer backing. In other words, when the album is opened, the album cover 10 is formed as the flat planer backing while the album pages can be turned flatly.

As shown in FIG. 1, the folding arrangement 30 further comprises a flexible sheet 31 having two longitudinal edges coupling at an outer side of the last album page 22 and an inner side of the back cover panel 12 to retain the last album page 22 being overlapped on the back cover panel 12 in a slidably movable manner.

As shown in FIG. 1, the flexible sheet 31, having an elongated structure, defines two the longitudinal edges extending in a parallel manner and coupling at mid-sections of the last album page 22 and the back cover panel 12 respectively. It is worth to mention that a width of the flexible sheet 31 is at least equal to a width of the spine panel 13. Accordingly, the width of the flexible sheet 31 is a distance between the two longitudinal edges thereof.

Figure 2:
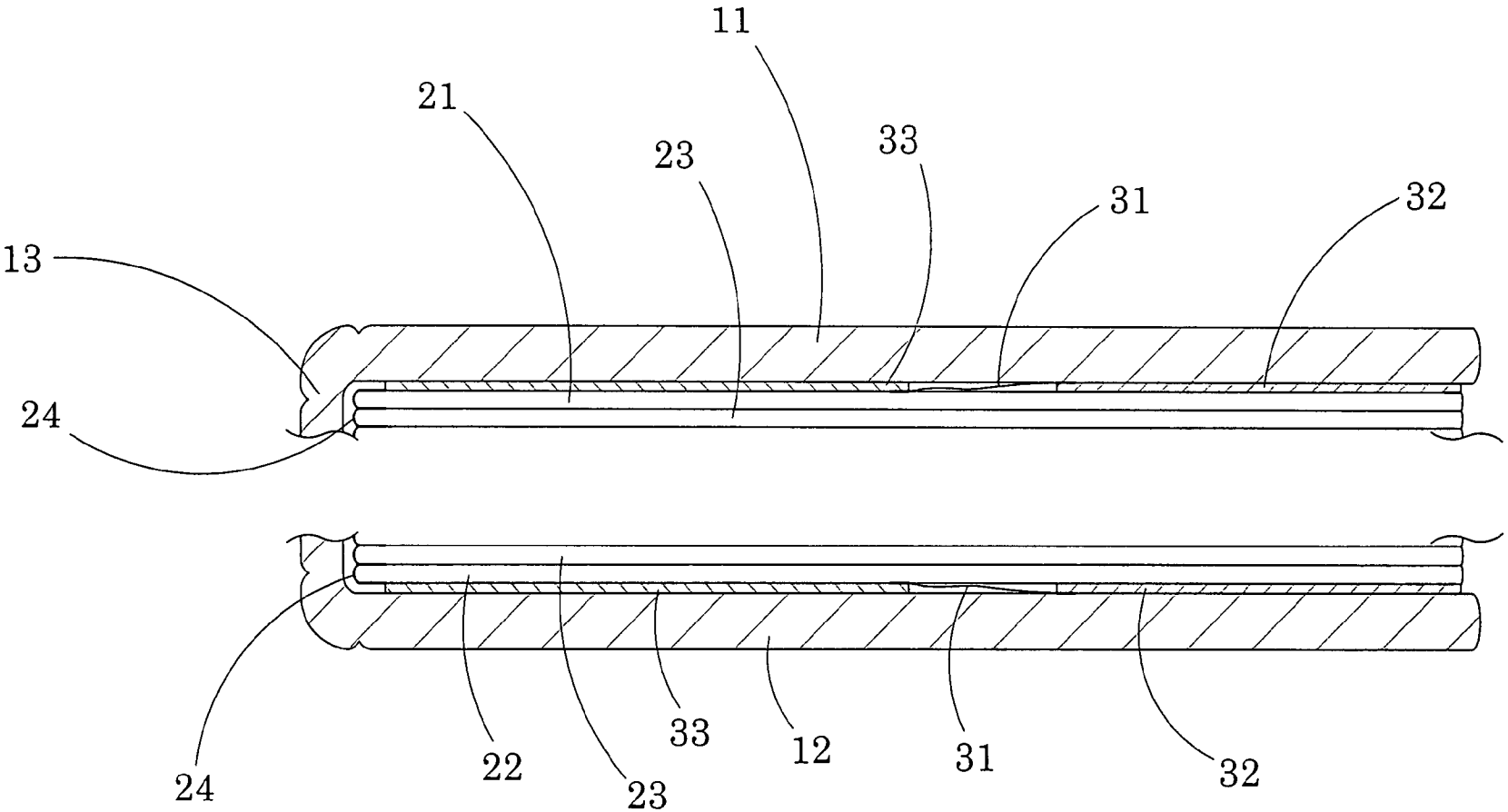
FIG. 2 is a sectional view of a photo album according to the above preferred embodiment of the present invention, illustrating the album cover at a closed position.
Figure 3:
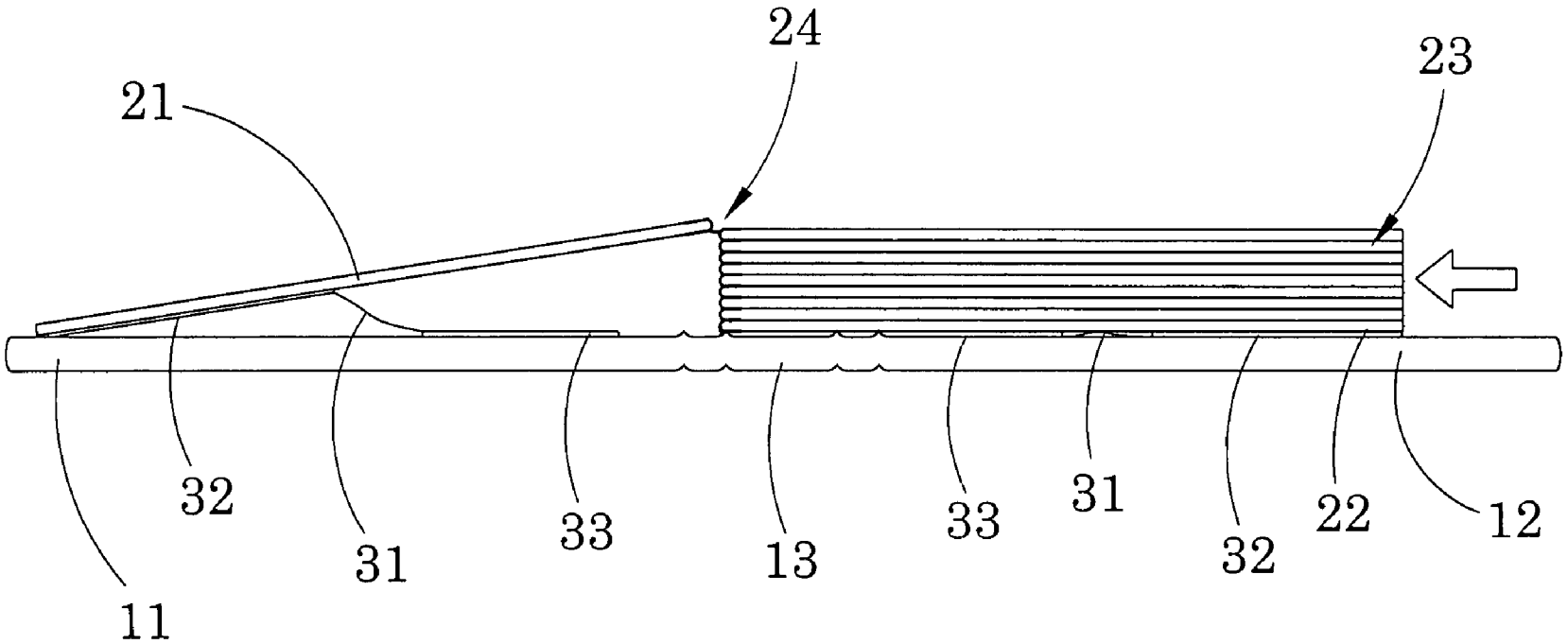
FIG. 3 is a sectional view of a photo album according to the above preferred embodiment of the present invention, illustrating the album cover at an opened position.

As shown in FIG. 2, the flexible sheet 31 is overlappedly sandwiched between the back cover panel 12 and the last album page 22. When the front cover panel 11 is folded at the opened position to align with the back cover panel 12 to form the flat planar backing, the flexible sheet 31 is folded up-side-down to overlappedly sandwich between the back cover panel 12 and the last album page 22. In other words, when the front cover panel 11 is folded at the closed position to overlap with the back cover panel 12, a first side of the flexible sheet 31 is overlapped with the outer side of the last album page 22 while an opposed second side of the flexible sheet 31 is overlapped with the inner side of the back cover panel 12. When the front cover panel 11 is folded at the opened position to align with the back cover panel 12, the first side of the flexible sheet 31 is overlapped with the inner side of the back cover panel 12 while the second side of the flexible sheet 31 is overlapped with the outer side of the last album page 22. Therefore, the reversible folding movement of the flexible sheet 31 enables the album pages being slidably shifted on the back cover panel 12.

In addition, the folding arrangement 30 further comprises a first retention sheet 32 overlappedly affixed to the outer side of last album page 22 to retain one of the longitudinal edges of the flexible sheet 31 in position, and a second retention sheet 33 overlappedly affixed to the inner side of the back cover panel 12 to retain another longitudinal edge of the flexible sheet 31 in position, such that the first and second retention sheets 32, 33 hold the last album page 22 being overlapped on the back cover panel 12 in a slidably movable manner. Preferably, the total width of the flexible sheet 31 and the first and second retention sheets 32, 33 is the same as the width of the back cover panel 12.

Accordingly, when the flexible sheet 31 is coupled between the back cover panel 12 and the last album page 22, the flexible sheet 31 may be detached from one of the back cover panel 12 and the last album page 22 accidentally by an excessive pulling force. Therefore, when the first and second retention sheets 32, 33 are mounted at the last album page 22 and the back cover panel 12 respectively, the longitudinal edges of the flexible sheet 31 can be securely affixed to the back cover panel 12 and the last album page 22 respectively so as to evenly distribute the pulling force between the back cover panel 12 and the last album page 22.

According to the preferred embodiment, an outer edge of the first album page 21 is affixed to an outer edge of the front cover panel 11, such that when the front cover panel 11 is folded at the opened position at the first album page 21, the album pages are concurrently and slidably shifted on the back cover panel 12 via the folding arrangement 30. Accordingly, the outer edge of the first album page 21 is affixed to the outer edge of the front cover panel 11 by glue as shown in FIG. 2. In addition, the folding arrangement 30 can also be provided between the first album page 21 and the front cover panel 11 as shown in FIGS. 1 and 2. Therefore, the user is able to remove the attachment between the outer edge of the first album page 21 and the outer edge of the front cover panel 11 such that the first album page 21 is adapted to be overlappedly slid at the front cover panel 11 as shown for the overlappedly sliding movement between the last album page 22 and the back cover panel 12. In other words, the user has an option to allow the sliding movement of the last album page 22 only by keeping the glue between the first album page 21 and the front cover panel 11, or to allow the sliding movements of both the first and album pages 21, 22 by removing the glue between the first album page 21 and the front cover panel 11.

It is worth to mention that the album of the present invention can provide two folding arrangement 30 at a position one of the folding arrangements 30 is provided between the first album page 21 and the front cover panel 11 while another folding arrangement 30 is provided between the last album page 22 and the back cover panel 12. Therefore, the album retainer 20 is adapted to be self-adjustably slid at the front and back cover panels 11, 12. In addition, when two folding arrangements 30 are used, a total width of the two flexible sheets 31 is at least equal to a width of the spine panel 13.

Each of the album pages is made of photo printable material that the photo is directly printed on each of the album pages. Thereafter, the album pages are bounded at the inner edges via the edge leaves 24. Alternatively, each of the album pages can comprises a photo holder for retaining one or more photos being overlapped on the respective side of the album page. Accordingly, the photo holder can be a sheet of transparent layer overlapping on the respective side of the album page to hold the photo therebetween.

Figure 4:
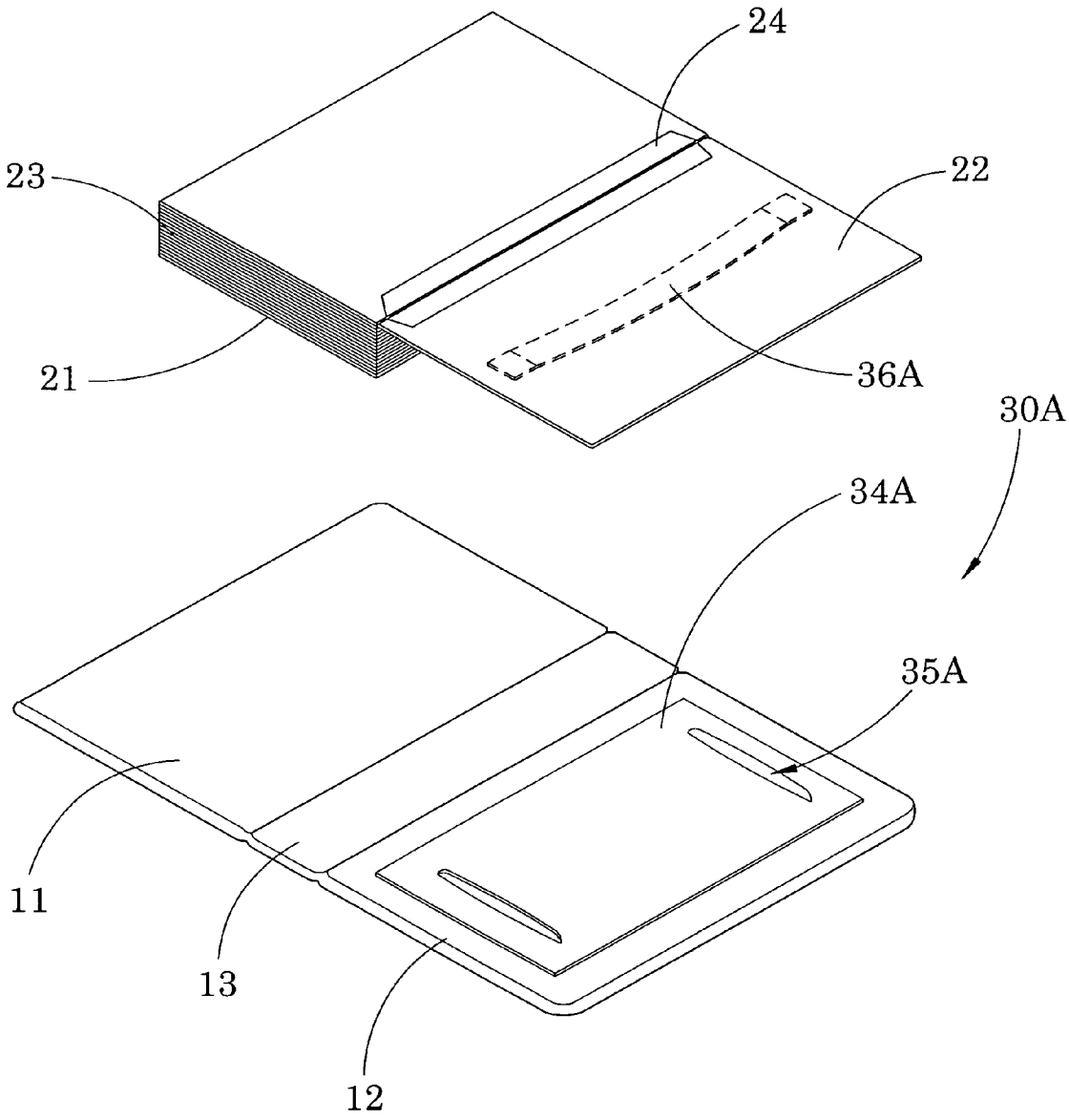
FIG. 4 is an exploded perspective view of a photo album according to a first alternative mode of the folding arrangement of the preferred embodiment of the present invention.

FIG. 4 illustrates an alternative mode of the folding arrangement 30A which comprises a sliding panel 34A overlappedly affixed on an inner side of the back cover panel 12, and a sliding member 36A affixed to an outer side of the last album page 22.

Accordingly, the sliding panel 34A has two spaced apart opening slits formed thereon to define a transverse sliding channel 35A between the two opening slits. In particularly, the peripheral edge of the sliding panel 34A is affixed to the inner side of the back cover panel 12 such that the sliding member 36A is adapted to slidably pass through the transverse sliding channel 35A through the opening slits. Accordingly, a width of the transverse sliding channel 35A is at least equal to a width of the spine panel 13.

Figure 5A:
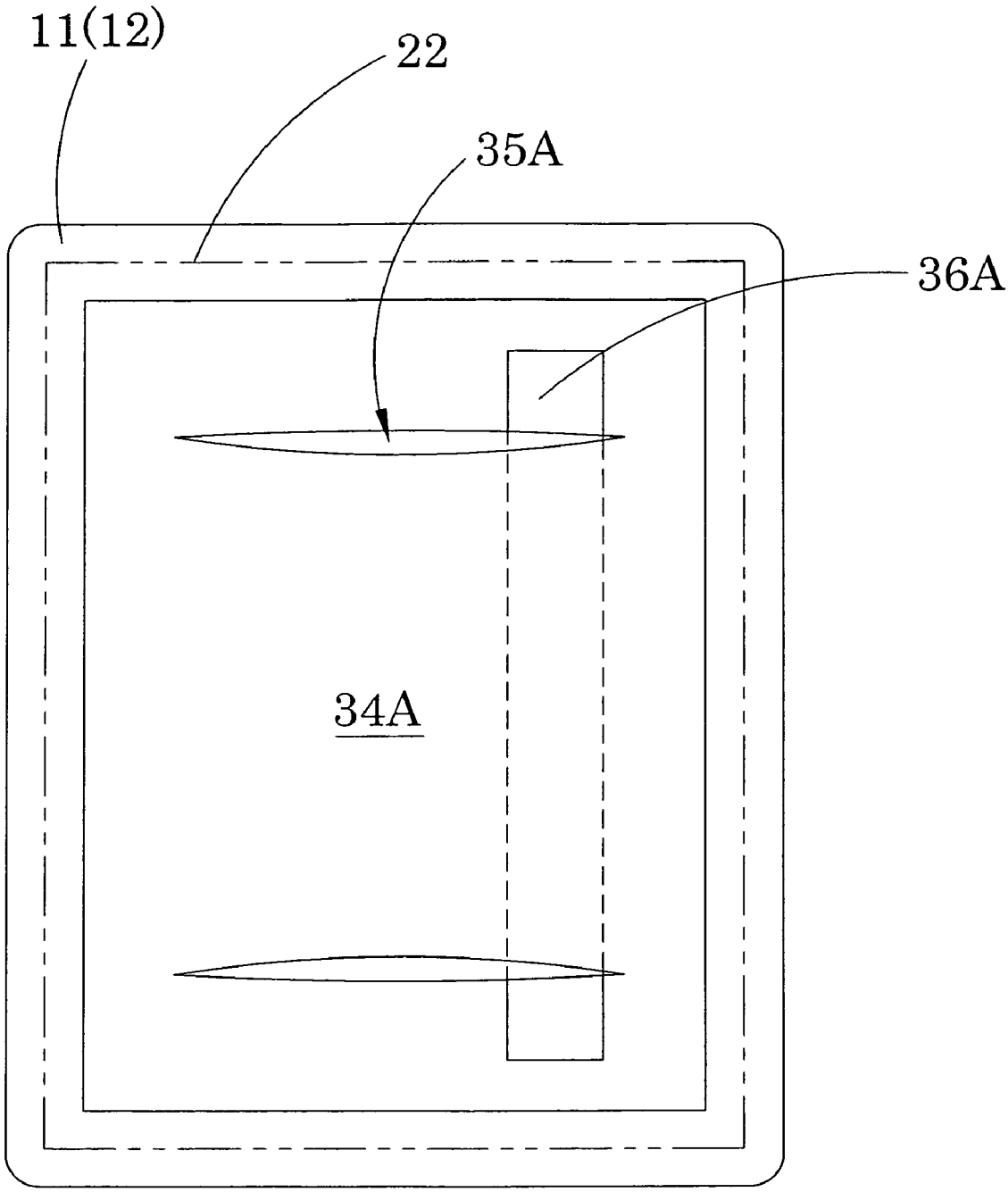
FIGS. 5A and 5B are top views of a photo album according to the first alternative mode of the folding arrangement of the preferred embodiment of the present invention, illustrating the album cover being folded between the closed position and the opened position.

The sliding member 36A is affixed to the outer side of the last album page 22 to slidably engage with the sliding channel 35A of the sliding panel 34A in such a manner that the last album page 22 is overlapped on the back cover panel 12 in a slidably movable manner. As shown in FIG. 5A, the sliding member 36A has two affixing ends spacedly affixed to the outer side of the last album 22, wherein a portion of the sliding member 36A, which is a portion between the affixing ends thereof, is extended through the sliding channel 35 of the sliding panel 34.

Figure 5B:
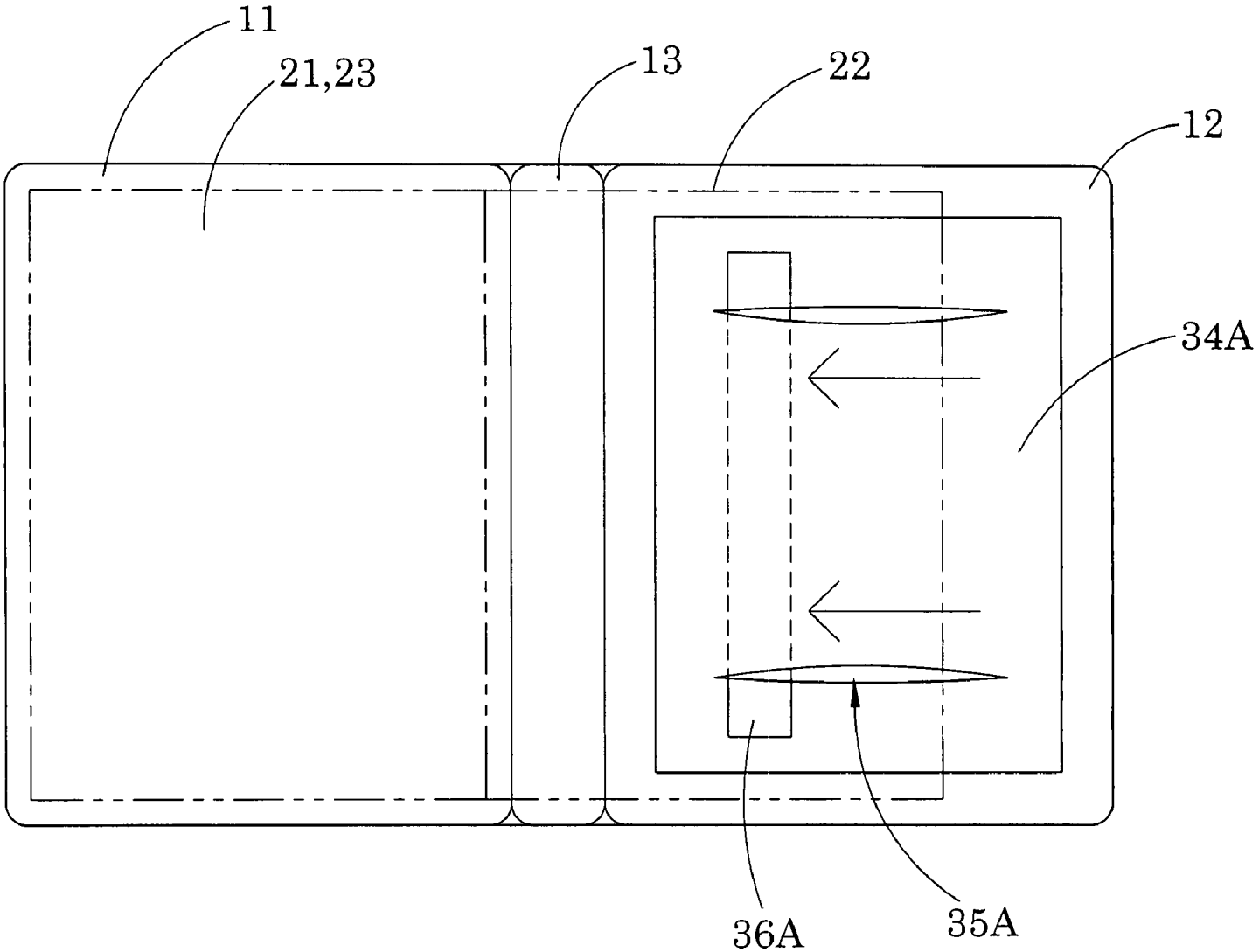

As shown in FIG. 5A, when the album is folded at the closed position to overlap the front cover panel 11 with the back cover panel 12, the sliding member 36A is transversely slid at one side of the sliding channel 35A. When the album is folded at the opened position to form the flat planer backing with the front cover panel 11, the spine panel 13, and the back cover panel 12, the sliding member 36A is transversely slid to another side of the sliding channel 35A, as shown in FIG. 5B. It is worth to mention that since the sliding member 36A is slidably engaged with the sliding panel 34A through the sliding channel 35A, the last album page 22 is kept being overlapped with the back cover panel 12.

Figure 6:
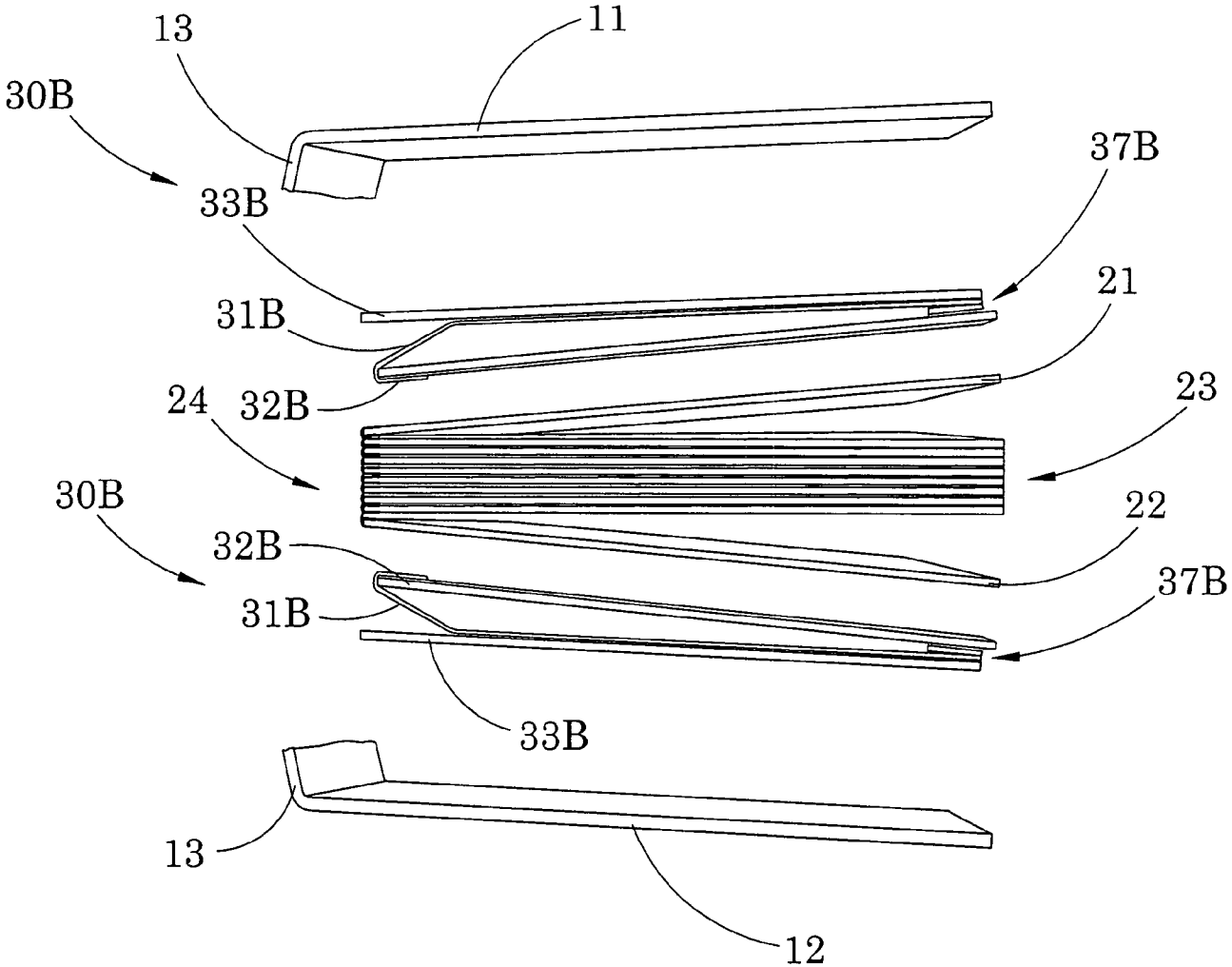
FIG. 6 is an exploded perspective view of the photo album according to a second alternative mode of the folding arrangement of the preferred embodiment of the present invention.
Figure 7:
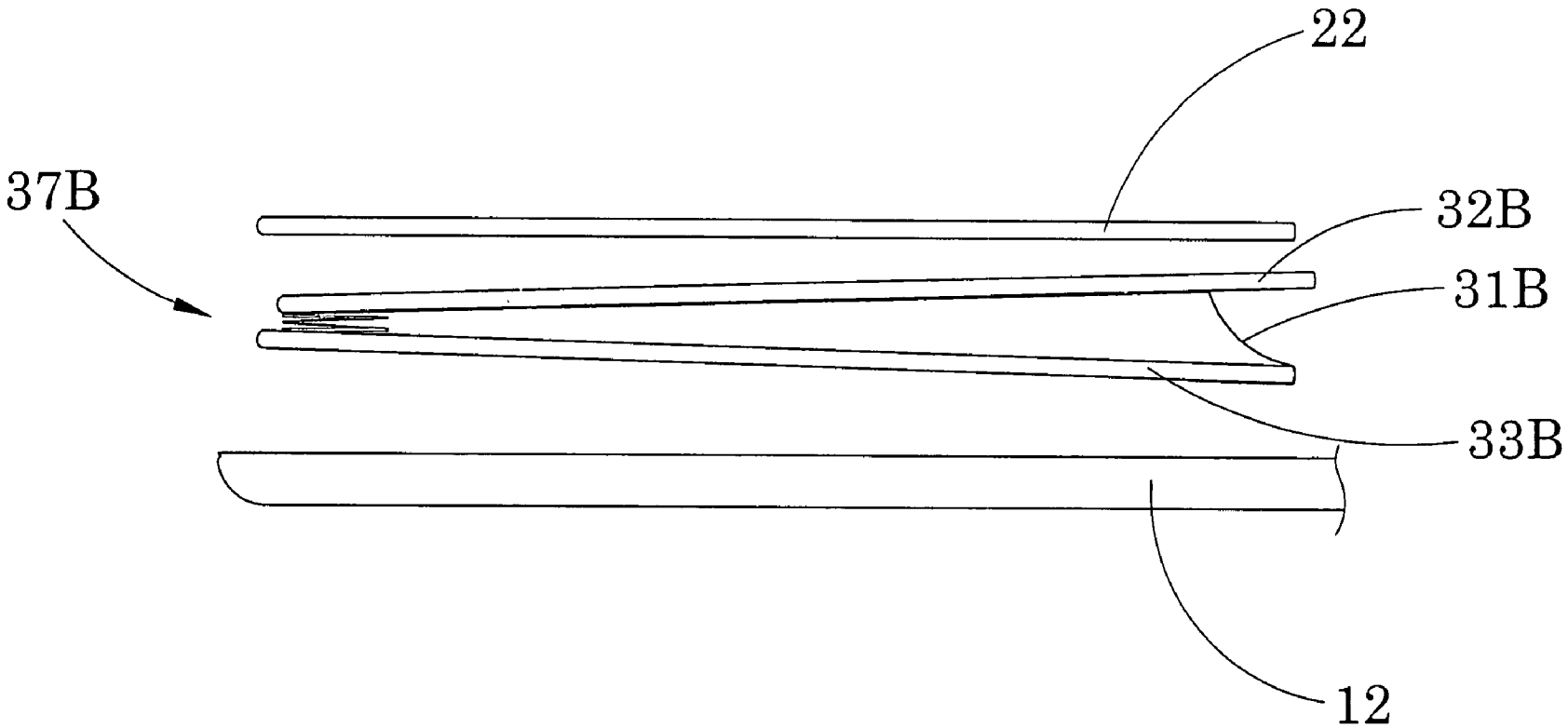
FIG. 7 is a side view of the folding arrangement according to the second alternative mode of the folding arrangement of the preferred embodiment of the present invention.

FIGS. 6 and 7 illustrate another alternative mode of the folding arrangement 30B which comprises a first retention sheet 32B overlappedly affixed to an outer side of the last album page 22, a second retention sheet 33B overlappedly affixed to an inner side of the back cover panel 12, and a flexible sheet 31B extending between the first and second retention sheets 32B, 33B to allow the first retention sheet 32B being slid at the second retention sheet 33B, so as to overlap the last album page 22 on the back cover panel 12 in a slidably movable manner.

Accordingly, the difference between the above preferred embodiment and this alternative is that the first and second retention sheets 32, 33 of the preferred embodiment are partially overlapped with the front and back cover panels 11, 12 to ensure the attachment of the flexible sheet 31, wherein the first and second retention sheets 32B, 33B of this alternative are entirely overlapped with the front and back cover panels 11, 12 to link with the flexible sheet 31B. Likewise, the flexible sheet 31B has two longitudinal edges coupling between the first and second retention sheets 32B, 33B to retain the last album page 22 being overlapped on the back cover panel 12 in a slidably movable manner. It is worth to mention that a width of the flexible sheet 31B is at least equal to a width of the spine panel 13.

Figure 8:
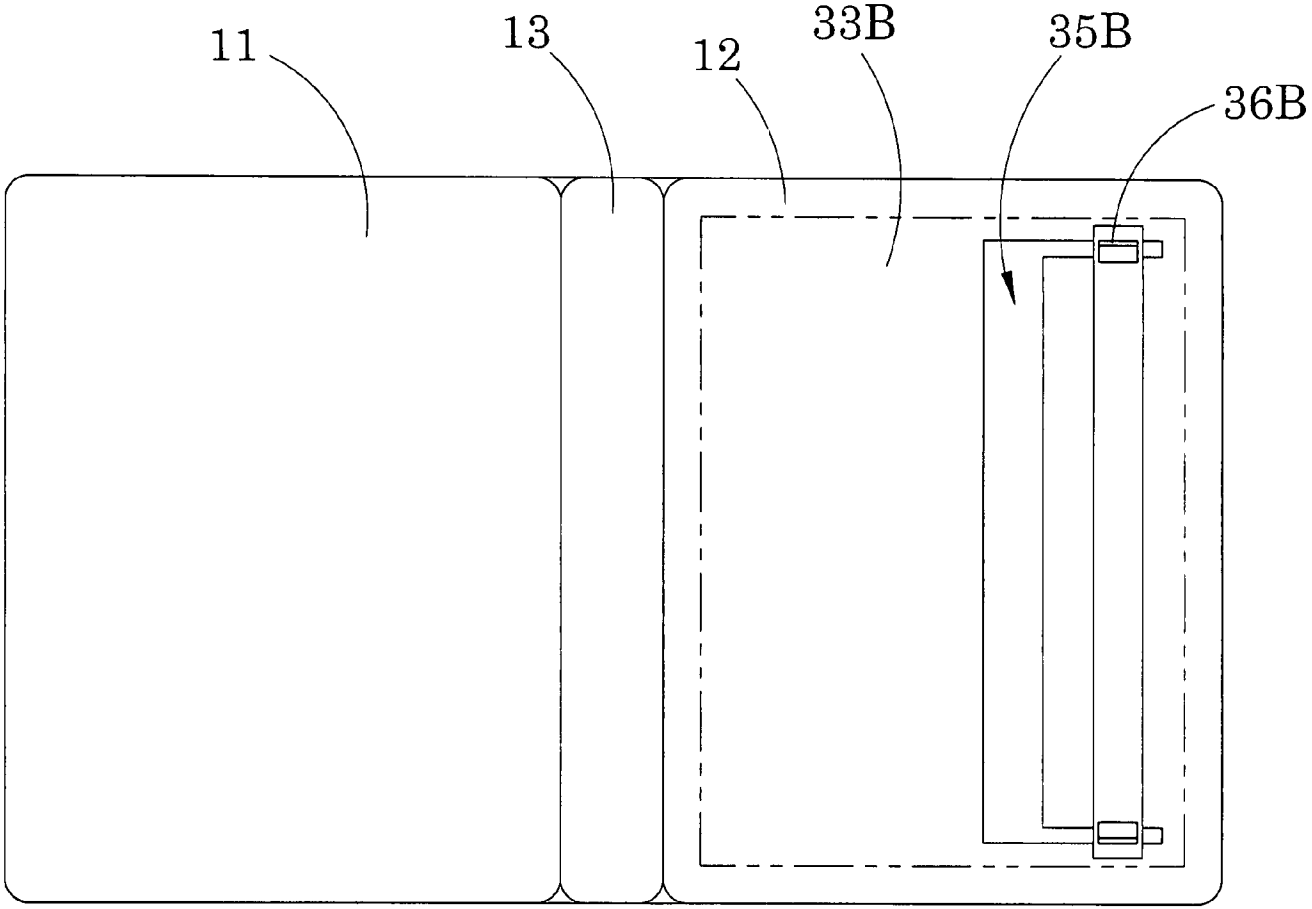
FIG. 8 is a top view of a photo album according to the second alternative mode of the folding arrangement of the preferred embodiment of the present invention, illustrating the album cover at the opened position.
Figure 9:
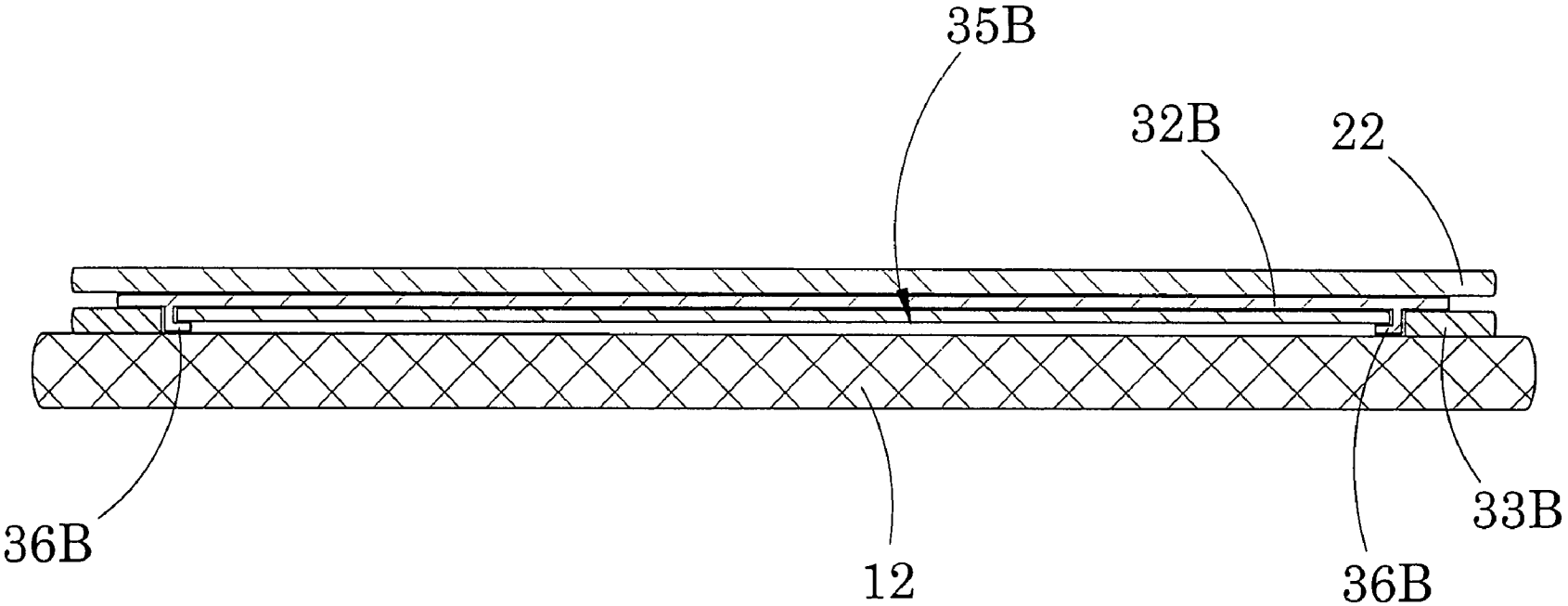
FIG. 9 is a sectional view of the folding arrangement according to the second alternative mode of the folding arrangement of the preferred embodiment of the present invention.

As shown in FIGS. 8 and 9, the folding arrangement 30B further comprises a sliding unit 37B coupling between two outer edge portions of the first and second retention sheets 32B, 33B to guide the last album page 22 being slid at the back cover panel 12. The sliding unit 37B further contains a sliding channel 35B transversely formed at the outer edge portion of the second retention sheet 33B and a sliding member 36B affixed to the outer edge portion of the first retention sheet 32B to slidably engage with the sliding channel 35B in such a manner that the last album page 22 is overlapped on the back cover panel 12 in a slidably movable manner. It is worth to mention the sliding unit 37B ensures the last album page 22 being overlappedly slid at the back cover panel 12.

As shown in FIG. 9, the sliding member 36B comprises two spaced apart L-shaped sliders downwardly extended from the first retention sheet 32B to slidably engage with the sliding channel 35B.

As shown in FIG. 6, two folding arrangements 30B are provided that one of the folding arrangements 30B is provided between the last album page 22 and the back cover panel 12 while another folding arrangement 30B is provided between the first album page 21 and the front cover panel 11. Therefore, the album retainer 20 is adapted to be self-adjustably slid at the front and back cover panels 11, 12. In addition, when two folding arrangements 30B are used, a total width of the two flexible sheets 31B is at least equal to a width of the spine panel 13.

According to the preferred embodiment, the present invention further provides a method of manufacturing an album, comprising the steps of:

(a) providing a book-like album cover which comprises a front cover panel 11, a back cover panel 12, and a spine panel 13 extending between the front and back cover panels 11, 12 edge-to-edge;

(b) providing an album retainer 20 which comprises a plurality of album pages to define a first album page 21 overlappedly coupled with the front cover panel 11, a last album page 22, a plurality of intermediate album pages overlapping between the first and last album pages 21, 22, wherein inner edges of the album pages are bound with each other such that the album retainer 20 is adapted to be turned from the first album page 21 to the last album page 22; and (c) overlapping the last album page 22 with the back cover panel 12 in a slidably movable manner, wherein when the album cover 10 is folded at an opened position, the last album page 22 is overlappedly slid along the back cover panel 12 to allow the front cover panel 11, the spine panel 13, and the back cover panel 12 to form a flat planer backing, while two neighboring album pages are aligned in a planer manner.

Accordingly, the step (c) comprises the step of:

(c.1) coupling two longitudinal edges of a flexible sheet 31 at an outer side of last album page and an inner side of the back cover panel 12 to retain the last album page 22 being overlapped on the back cover panel 12 in a slidably movable manner.

(c.2) overlappedly affixing a first retention sheet 32 to the outer side of last album page 22 to retain one of the longitudinal edges of the flexible sheet 31 in position; and (c.3) overlappedly affixing a second retention sheet 33 to the inner side of the back cover panel 12 to retain another the longitudinal edge of the flexible sheet 31 in position, such that the first and second retention sheets 32, 33 hold the last album page 22 being overlapped on the back cover panel 12 in a slidably movable manner.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An album, comprising:

a book-like album cover which comprises a front cover panel a back cover panel, and a spine panel extending between said front and back cover panels edge-to-edge;

an album retainer which comprises a plurality of album pages to define a first album page overlappedly coupled with said front cover panel, a last album page, a plurality of intermediate album pages overlapping between said first and last album pages, wherein inner edges of said album pages are bound with each other such that said album retainer is adapted to be turned from said first album page to said last album page; and a folding arrangement coupling between said last album page and said back cover panel at a position that said last album page is overlapped with said back cover panel in a slidably movable manner, wherein when said album cover is folded at an opened position, said last album page is overlappedly slid along said back cover panel to allow said front cover panel, said spine panel, and said back cover panel to form a flat planer backing, while said two neighboring album pages are aligned in a planer manner;

wherein said folding arrangement comprises a flexible sheet having two longitudinal edges coupling at an outer side of last album page and an inner side of said back cover panel to retain said last album page being overlapped on said back cover panel in a slidably movable manner.

2. The album, as recited in claim 1, wherein a width of said flexible sheet is at least equal to a width of said spine panel.

3. The album, as recited in claim 1, wherein said flexible sheet, having an elongated structure, defines said two longitudinal edges extending in a parallel manner and coupling at mid-sections of said last album page and said back cover panel respectively.

4. The album, as recited in claim 2, wherein said flexible sheet, having an elongated structure, defines said two longitudinal edges extending in a parallel manner and coupling at mid-sections of said last album page and said back cover panel respectively.

5. The album, as recited in claim 1, wherein said folding arrangement further comprises a first retention sheet overlappedly affixed to said outer side of last album page to retain one of said longitudinal edges of said flexible sheet in position, and a second retention sheet overlappedly affixed to said inner side of said back cover panel to retain another said longitudinal edge of said flexible sheet in position, such that said first and second retention sheets hold said last album page being overlapped on said back cover panel in a slidably movable manner.

6. The album, as recited in claim 4, wherein said folding arrangement further comprises a first retention sheet overlappedly affixed to said outer side of last album page to retain one of said longitudinal edges of said flexible sheet in position, and a second retention sheet overlappedly affixed to said inner side of said back cover panel to retain another said longitudinal edge of said flexible sheet in position, such that said first and second retention sheets hold said last album page being overlapped on said back cover panel in a slidably movable manner.

7. The album, as recited in claim 2, wherein an outer edge of said first album page is affixed to an outer edge of said front cover panel, such that when said front cover panel is folded at said opened position at said first album page, said album pages are concurrently and slidably shifted on said back cover panel via said folding arrangement.

8. The album, as recited in claim 6, wherein an outer edge of said first album page is affixed to an outer edge of said front cover panel, such that when said front cover panel is folded at said opened position at said first album page, said album pages are concurrently and slidablity shifted on said back cover panel via said folding arrangement.

9. The album, as recited in claim 8, wherein each of said album pages made of photo printable material that a photo is directly printed on each of said album pages, wherein said album retainer further comprises a plurality of edge leaves connecting said inner edges of said album pages respectively, wherein each of said edge leaves coupling between two sequent album pages at a position said inner edges of said sequent album pages are spaced part from each other such that said two neighboring album pages are aligned in a planer manner when said neighboring album pages are folded to overlap on said front and back cover panels respectively at said opened position.

10. An album, comprising:

a book-like album cover which comprises a front cover panel, a back cover panel, and a spine panel extending between said front and back cover panels edge-to-edge;

an album retainer which comprises a plurality of album pages to define a first album page overlappedly coupled with said front cover panel, a last album page, a plurality of intermediate album pages overlapping between said first and last album pages, wherein inner edges of said album pages are bound with each other such that said album retainer is adapted to be turned from said first album page to said last album page; and a folding arrangement coupling between said last album page and said back cover panel at a position that said last album. page is overlapped with said back cover panel in a slidably movable manner, wherein when said album cover is folded at an opened position, said last album page is overlappedly slid along said back cover panel to allow said front cover panel, said spine panel, and said back cover panel to form a flat planer backing, while said two neighboring album pages are aligned in a planer manner;

wherein said folding arrangement comprises a sliding panel, having a transverse sliding channel, overlappedly affixed on an inner side of said back cover panel, and a sliding member affixed to an outer side of said last album page to slidably engage with said sliding channel of said sliding panel in such a manner that said last album page is overlapped on said back cover panel in a slidably movable manner.

11. The album, as recited in claim 10, wherein a width of said sliding channel is at least equal to a width of said spine panel.

12. The album, as recited in claim 11, wherein said sliding member, which is extended through said sliding channel of said sliding panel, has two affixing ends spacedly affixed to said outer side of said last album.

13. An album, comprising:

a book-like album cover which comprises a front cover panel, a back cover panel, and a spine panel extending between said front and back cover panels edge-to-edge;

an album retainer which comprises a plurality of album pages to define a first album page overlappedly coupled with said front cover panel, a last album page, a plurality of intermediate album pages overlapping between said first and last album pages, wherein inner edges of said album pages are bound with each other such that said album retainer is adapted to be turned from said first album page to said last album page; and a folding arrangement coupling between said last album page and said back cover panel at a position that said last album page is overlapped with said back cover panel in a slidably movable manner, wherein when said album cover is folded at an opened position, said last album page is overlappedly slid along said back cover panel to allow said front cover panel, said spine panel, and back cover panel to form a flat planer backing, while said two neighboring album pages are aligned in a planer manner;

wherein said folding arrangement comprises a first retention sheet overlappedly affixed to an outer side of last album page, a second retention sheet overlappedly affixed to an inner side of said back cover panel, and a flexible sheet extending between said first and second retention sheets to allow said first retention sheet being slid at said second retention sheet, so as to overlap said last album page on said back cover panel in a slidably movable manner.

14. The album, as recited in claim 13, wherein a width of said flexible sheet is at least equal to a width of said spine panel.

15. The album, as recited in claim 14, wherein said folding arrangement further comprises a sliding unit coupling between two outer edge portions of said first and second retention sheets to guide said last album page being slid at said back cover panel.

16. The album, as recited in claim 15, wherein said sliding unit contains a sliding channel transversely formed at said outer edge portion of said second retention sheet and a sliding member affixed to said outer edge portion of said first retention sheet to slidably engage with said sliding channel in such a manner that said last album page is overlapped on said back cover panel in a slidably movable manner.

17. The album, as recited in claim 16, wherein a width of said sliding channel is at least equal to the width of said spine panel.

18. A method of manufacturing an album, comprising the steps of:

(a) providing a book-like album cover which comprises a front cover panel, a back cover panel, and a spine panel extending between said front and back cover panels edge-to-edge;

(b) providing an album retainer which comprises a plurality of album pages to define a first album page overlappedly coupled with said front cover panel, a last album page, a Plurality of intermediate album pages overlapping between said first and last album pages, wherein inner edges of said album pages are bound with each other such that said album retainer is adapted to be turned from said first album page to said last album page; and (c) overlapping said last album page with said back cover panel in a slidably movable manner wherein when said album cover is folded at an opened position said last album page is overlappedly slid along; said back cover panel to allow said front cover panel, said spine panel, and said back cover panel to form a flat planer backing, while said two neighboring album pages are aligned in a planer manner;

wherein the step (c) comprises a step of:

(c.1) coupling two longitudinal edges of a flexible sheet at an outer side of last album page and an inner side of said back cover panel to retain said last album page being overlapped on said back cover panel in a slidably movable manner.

19. The method, recited in claim 18, wherein a width of said flexible sheet is at least equal to a width of said spine panel.

20. The method, as recited in claim 19, wherein the step (c) further comprises the steps of:

(c.2) overlappedly affixing a first retention sheet to said outer side of last album page to retain one of said longitudinal edges of said flexible sheet in position; and (c.3) overlappedly affixing a second retention sheet to said inner side of said back cover panel to retain another said longitudinal edge of said flexible sheet in position, such that said first and second retention sheets hold said last album page being overlapped on said back cover panel in a slidably movable manner.

21. The method, as recited in claim 19, wherein the step (c) further comprises the steps of:

(c.2) overlappedly affixing a first retention sheet to an outer side of last album page;

(c.3) overlappedly affixing a second retention sheet to an inner side of said back cover panel; and (c.4) extending a flexible sheet between said first and second retention sheets to allow said first retention sheet being slid at said second retention sheet, so as to overlap said last album page on said back cover panel in a slidably movable manner.

22. The method, recited in claim 21, wherein a width of said flexible sheet is at least equal to a width of said spine panel.

* * * * *